US012000652B2

(12) United States Patent
Poulos et al.

(10) Patent No.: US 12,000,652 B2
(45) Date of Patent: Jun. 4, 2024

(54) WEARABLE HYDRATION/COOLING SYSTEM

(71) Applicant: WG Products LLC, Chicago, IL (US)

(72) Inventors: James Poulos, Northbrook, IL (US); Peter F. Andreou, Northbrook, IL (US); Katelyn Poulos, Northbrook, IL (US)

(73) Assignee: WG Products LLC, Chicago, IL (US)

( * ) Notice: Subject to any disclaimer, the term of this patent is extended or adjusted under 35 U.S.C. 154(b) by 130 days.

(21) Appl. No.: 17/733,060

(22) Filed: Apr. 29, 2022

(65) Prior Publication Data

US 2022/0349649 A1 Nov. 3, 2022

Related U.S. Application Data

(60) Provisional application No. 63/181,710, filed on Apr. 29, 2021.

(51) Int. Cl.

| | |
|---|---|
| ***A45F 3/20*** | (2006.01) |
| ***F25D 21/14*** | (2006.01) |
| ***F25D 31/00*** | (2006.01) |

(52) U.S. Cl.

CPC ..... *F25D 31/002* (2013.01); *A45F 3/20* (2013.01); *F25D 21/14* (2013.01); (Continued)

(58) Field of Classification Search

CPC ..... F25D 2400/26; A41D 2400/46; A41D 13/0053; A41D 13/0056; A41D 13/0058; (Continued)

(56) References Cited

U.S. PATENT DOCUMENTS 4,641,655 A * 2/1987 Abt ..... A61F 7/10 607/109
4,805,619 A * 2/1989 Swearingen ..... A61F 7/103 607/109

(Continued)

FOREIGN PATENT DOCUMENTS

KR 20140141161 A 12/2014
KR 101977325 B1 5/2019

(Continued)

OTHER PUBLICATIONS https://www.amazon.com/Bare-Neckd-Real-Cooling-Towel/dp/B07CW51MTF?th=1%3E. (Year: 2023).*

(Continued)

*Primary Examiner* — Scott T McNurlen
(74) *Attorney, Agent, or Firm* — Banner & Witcoff, Ltd.

(57) ABSTRACT

An apparatus comprises a cooling medium compartment between first and second beverage compartments, and a water permeable membrane. The cooling medium compartment comprises a topside zipper and underside zipper. When the underside zipper is closed, there is no opening between the cooling medium compartment and the water permeable membrane. When the underside zipper is at least a partially open, there is an opening between the cooling medium compartment and the permeable membrane to allow water to move from the cooling medium compartment to the permeable membrane. The apparatus provides the option of whether or not to cool the back of the user's neck with a cooling medium placed in the apparatus that wets a water permeable portion of the apparatus that is in contact with the neck of the user.

23 Claims, 8 Drawing Sheets

(52) U.S. Cl.
CPC .. *F25D 2303/081* (2013.01); *F25D 2303/082* (2013.01); *F25D 2321/147* (2013.01); *F25D 2400/26* (2013.01)

(58) Field of Classification Search
CPC ..... A41D 2023/002; A41D 20/005; A45F 2003/166; A45F 3/16; A45F 2200/0583
See application file for complete search history.

(56) References Cited

U.S. PATENT DOCUMENTS

| | | | | |
|---|---|---|---|---|
| 4,832,030 | A | 5/1989 | De Canto | |
| 5,072,598 | A * | 12/1991 | Dibrell | A41D 13/0055 62/530 |
| 5,197,292 | A * | 3/1993 | McPherson | A42C 5/04 62/530 |
| 5,735,889 | A | 4/1998 | Burkett et al. | |
| 5,785,980 | A | 7/1998 | Mathewson | |
| 6,481,021 | B2 * | 11/2002 | Spell | A42B 1/0186 2/172 |
| 6,581,811 | B1 | 6/2003 | Schillaci | |
| 7,043,765 | B1 | 5/2006 | Otsubo | |
| 8,292,936 | B2 | 10/2012 | Jung | |
| 8,322,156 | B2 | 12/2012 | Searle | |
| 10,463,139 | B2 | 11/2019 | Sola et al. | |
| 10,709,184 | B2 * | 7/2020 | Moore | A41D 23/00 |
| 11,278,065 | B2 * | 3/2022 | Hubbs | A41D 3/00 |
| 2002/0052566 | A1 | 5/2002 | Sequeira | |
| 2004/0128747 | A1 | 7/2004 | Bumbarger et al. | |
| 2006/0065201 | A1 | 3/2006 | Cogliano et al. | |
| 2007/0225782 | A1 * | 9/2007 | Taylor | A61F 7/10 607/108 |
| 2013/0073016 | A1 | 3/2013 | Matsuo | |
| 2013/0284762 | A1 | 10/2013 | Voss | |
| 2017/0129687 | A1 * | 5/2017 | Atkins | A45F 3/20 |
| 2017/0266038 | A1 * | 9/2017 | Peavy | A41D 13/0053 |
| 2018/0243127 | A1 | 8/2018 | Chavarry et al. | |
| 2020/0196687 | A1 | 6/2020 | Hubbs | |
| 2020/0329795 | A1 * | 10/2020 | Rhodes | A41D 13/0058 |

FOREIGN PATENT DOCUMENTS

| | | | |
|---|---|---|---|
| WO | 1991016022 | A1 | 10/1991 |
| WO | 2000021473 | A1 | 4/2000 |
| WO | 2012083477 | A1 | 6/2012 |
| WO | 2018165696 | A1 | 9/2018 |

OTHER PUBLICATIONS https://www.walmart.com/ip/Refreezable-Ice-Bandana-Head-Wrap-Neck-Ice-Cooling-Scarf-Ice-Cooling-Headband-Neck-Ice-Pack/924069495. (Year: 2023).*

* cited by examiner

WEARABLE HYDRATION/COOLING SYSTEM

CROSS-REFERENCE TO RELATED APPLICATION

This application claims priority to U.S. Provisional Application No. 63/181,710 filed Apr. 29, 2021, which is hereby incorporated by reference in its entirety.

TECHNICAL FIELD

This invention relates generally to a wearable hydration system.

BACKGROUND

Personal hydration devices have been developed that can be worn by users. Some personal hydration devices have been designed to be worn around a user's neck. For example, Atkins Pub. No. 2017/0129687 discloses a beverage insulating sleeve that can hold two portable beverage containers, cold or hot packs and personal belongings around the back of the neck of a user.

Moore U.S. Pat. No. 10,709,184 discloses a hydration scarf to be worn around the neck to allow consumption of a beverage.

A disadvantage of the above exemplary conventional devices is that they do not provide the option of whether or not to cool the neck of a user with a cooling medium placed into the device that optionally wets a portion of the device that is in contact with the neck of the user. For example, the above exemplary conventional devices do not optionally allow water from the melting of ice held in such devices to wet a water permeable portion of the device that is in contact with the back of the neck of a user.

SUMMARY

An apparatus has now been developed that provides a user the option of whether or not to cool the back of the user's neck with a cooling medium placed in the apparatus that wets a water permeable portion of the apparatus that is in contact with the neck of the user.

In an embodiment, the apparatus comprises a holding tube. The holding tube repels water. The holding tube comprises at least a first compartment configured to hold a first beverage container at a first section of the holding tube, a second compartment configured to hold a second beverage container at a second section of the holding tube, and a third compartment configured to hold a cooling medium. The third compartment, also referred herein as the cooling medium compartment or cooling medium reservoir, is positioned between the first and second compartments. The apparatus comprises a water permeable membrane located below an underside of the cooling medium compartment.

The cooling medium compartment comprises a topside zipper located on the topside of the cooling medium compartment, and an underside zipper located on the underside of the cooling medium compartment. When the topside zipper is zipped to the closed position, there is no access from outside the holding tube to a space defined by the cooling medium compartment. When the topside zipper is unzipped to at least a partially open position, access is allowed from outside the holding tube to the space defined by the cooling medium compartment. The topside zipper allows a user to unzip the topside zipper to insert a cooling medium into the cooling medium compartment, and then zip the topside zipper to prevent the cooling medium from leaving the cooling medium compartment through the topside zipper.

A user can access the underside zipper when the topside zipper is unzipped to at least a partially open position. When the underside zipper is zipped to the closed position, there is no opening between the cooling medium compartment and the permeable membrane. When the underside zipper is unzipped to at least a partially open position, there is an opening between the cooling medium compartment and the permeable membrane to allow water to move from the cooling medium compartment to the permeable membrane. The permeable membrane is configured to allow a cooling medium, e.g., water formed from the melting of ice or condensate from a cold pack in the cooling medium compartment, to wet and permeate through the permeable membrane. In an embodiment, the holding tube made of a water repelling fabric, and the permeable membrane is made of a water permeable fabric that are comfortable to the skin of a user. The holding tube can form a U-shape, wherein the permeable membrane can be placed on the back of the neck of user, and the first and second compartments positioned to rest on the left and right front chest of the user.

Thus, a user can wear the apparatus and the user can opt to unzip the underside zipper to allow water from the cooling medium compartment to wet and permeate through the permeable membrane to cool the back of the user's neck.

In an embodiment, the apparatus further comprises a towel tube, wherein the holding tube and the permeable membrane are located within the towel tube. The towel tube is water absorbent. The towel tube comprises a towel having lateral sides and longitudinal sides, wherein the longitudinal sides are joined together. In this embodiment, the towel tube may fastened to the holding tube, and together can form a U-shape, wherein the bite portion of the U-shape has the cooling membrane compartment and permeable membrane. The bite portion of the U-shape can be placed on the back of the neck of user, and the first and second compartments positioned to rest on the left and right front chest of the user. The permeable membrane is configured to allow a cooling medium, e.g., water formed from the melting of ice or condensate from a cold pack in the cooling medium compartment, to wet and permeate through the permeable membrane, and then wet the portion of the towel tube resting on the back of the user's neck.

In an alternative embodiment, the apparatus comprises a water permeable membrane that is a tube or bag that may share a top zipper with the towel tube at the bite or middle portion of the towel tube. The permeable membrane bag may be affixed to the towel tube, for example by stitching, or snaps, buttons, or hooks and loops. The top zipper may be affixed to the towel tube before the towel is rolled to form the towel tube. In an aspect, the cooling medium compartment may also share the top zipper with the permeable membrane bag and the towel tube. In this embodiment, the cooling medium compartment is within the permeable membrane bag or tube, the combination of which may be characterized as a "bag within a bag." In this embodiment, there is no holding tube. In this embodiment, when the underside zipper of the cooling medium compartment is at least partially unzipped, water from cooling medium compartment can wet and permeate through the permeable membrane bag to cool the user's neck and wet the towel.

It is an object of the present invention to provide an apparatus that provides the option of whether or not to allow a liquid from a cooling medium, e.g., melted ice or condensate from a cold pack, to wet a portion of the towel tube.

It is an object of the present invention to provide an apparatus that may be easily used to cool the neck of a user with a portion of the apparatus that is wetted by water from melted ice or condensate from a cold pack held within in the apparatus.

These and other objects are set forth in the following description.

BRIEF DESCRIPTION OF THE DRAWINGS

In the detailed description that follows, reference will be made to the following figures.

DETAILED DESCRIPTION

Figure 1:
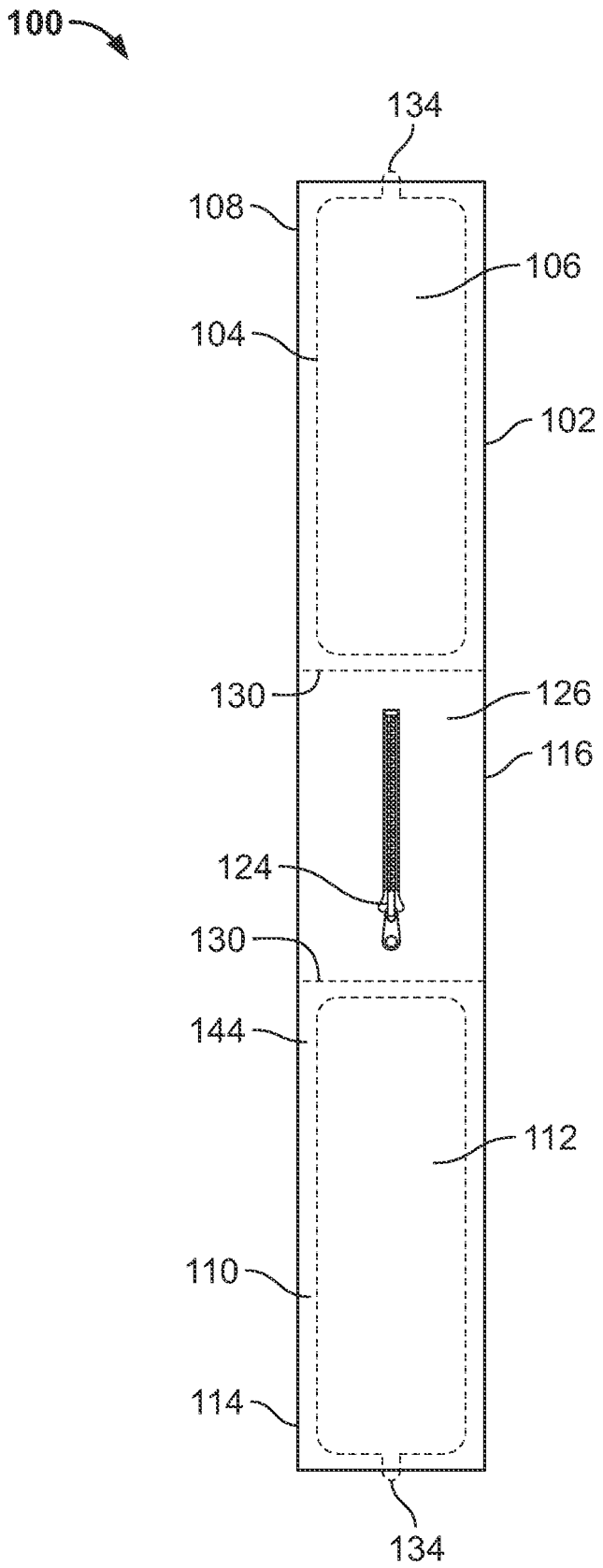
FIG. 1 is a semi-transparent top view showing of an embodiment of the apparatus according to the invention when laid flat, with the topside zipper in the closed position.

In reference to FIG. 1 through FIG. 5, apparatus 100 comprises holding tube 102. Holding tube 102 comprises at least first beverage compartment 104 configured to hold first beverage container 106 at first section 108 of holding tube 102, and second beverage compartment 110 configured to hold second beverage container 112 at second section 114 of holding tube 102. Holding tube 102 further comprises third compartment or cooling medium compartment 116 configured to hold a cooling medium 118 (not shown in FIG. 1 through FIG. 4). Cooling medium compartment 116 is positioned between first beverage compartment 104 and second beverage compartment 110. Cooling medium compartment 116 is separated from the beverage compartments by seams 130. The apparatus comprises water permeable membrane 120 located below underside 122 of cooling medium compartment 116.

Cooling medium compartment 116 comprises topside zipper 124 located on topside 126 of cooling medium compartment 116, and an underside zipper 128 located on underside 122 of cooling medium compartment 116. As shown in FIG. 1, when topside zipper 124 is zipped to the closed position, there is no access from outside holding tube 102 to a space defined by the cooling medium compartment 116.

Figure 2:
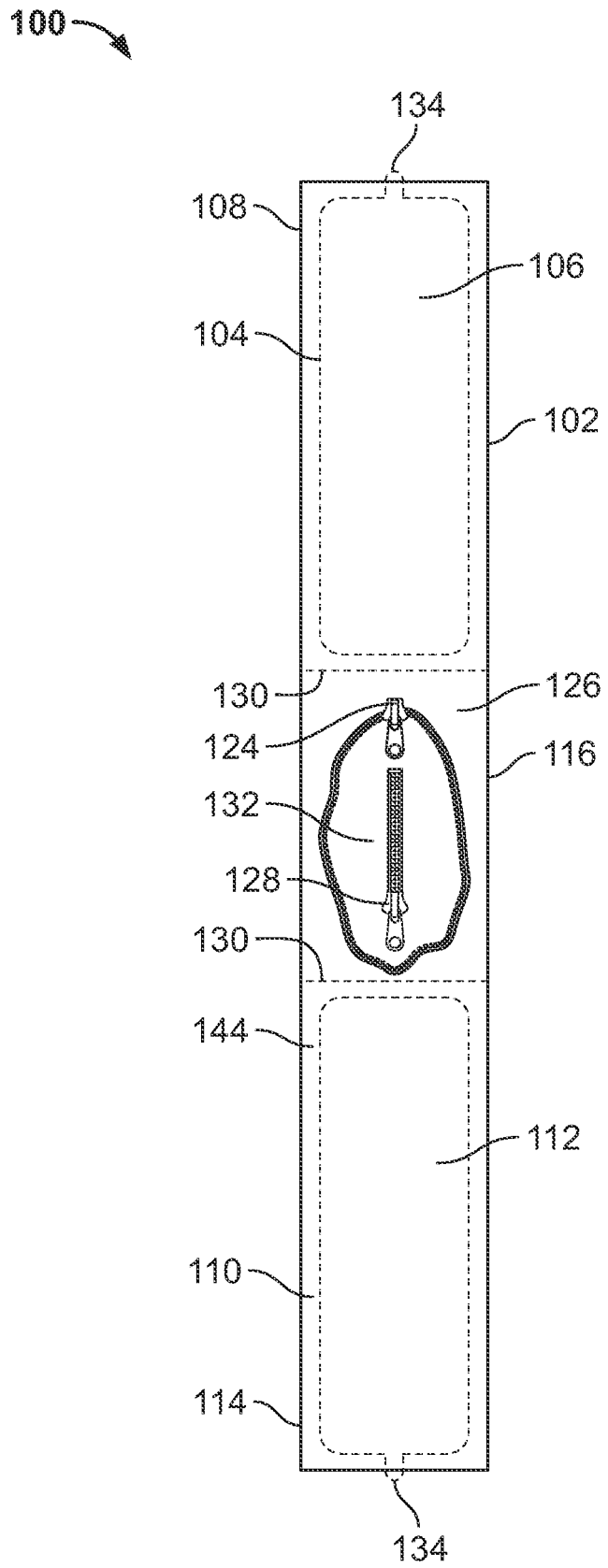
FIG. 2 is a semi-transparent top view showing the embodiment of FIG. 1, with the topside zipper in the open position, and the underside zipper in the closed position.

As shown in FIG. 2, when topside zipper 124 is unzipped to at least a partially open position, access is allowed from outside holding tube 102 to space 132 defined by cooling medium compartment 116. Topside zipper 124 allows a user to unzip topside zipper 124 to insert a cooling medium into cooling medium compartment 116, and then zip topside zipper 124 to prevent the cooling medium from leaving the cooling medium compartment through topside zipper 124.

A user can access underside zipper 128 when topside zipper 124 is unzipped to at least a partially open position as shown in FIG. 2. When underside zipper 128 is zipped to the closed position as shown in FIG. 2, there is no opening between cooling medium compartment 116 and permeable membrane 120.

Figure 3:
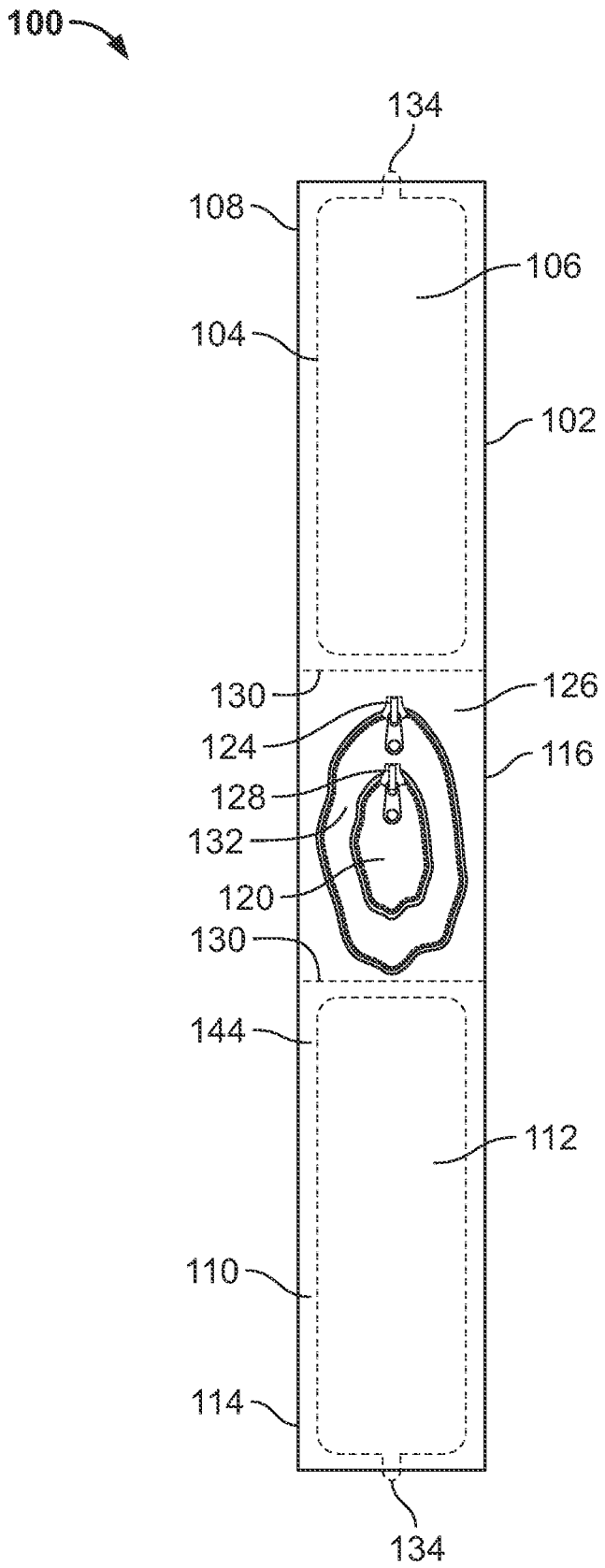
FIG. 3 is a semi-transparent top view showing of the embodiment of FIG. 1, with the topside zipper in the open position, and the underside zipper in the open position.

As shown in FIG. 3, when underside zipper 128 is unzipped to at least a partially open position, there is an opening between the cooling medium compartment 116 and permeable membrane 120 to allow water to move from cooling medium compartment 116 to permeable membrane 120. Permeable membrane 120 is configured to allow a cooling medium, e.g., water formed from the melting of ice or condensate from a cold pack in cooling medium compartment 116, to wet and permeate through permeable membrane 120. In an embodiment, holding tube 102 is made of a water repelling fabric, and permeable membrane 120 is made of a water permeable fabric. Preferably, these fabrics are comfortable to the skin of a user.

Figure 4:
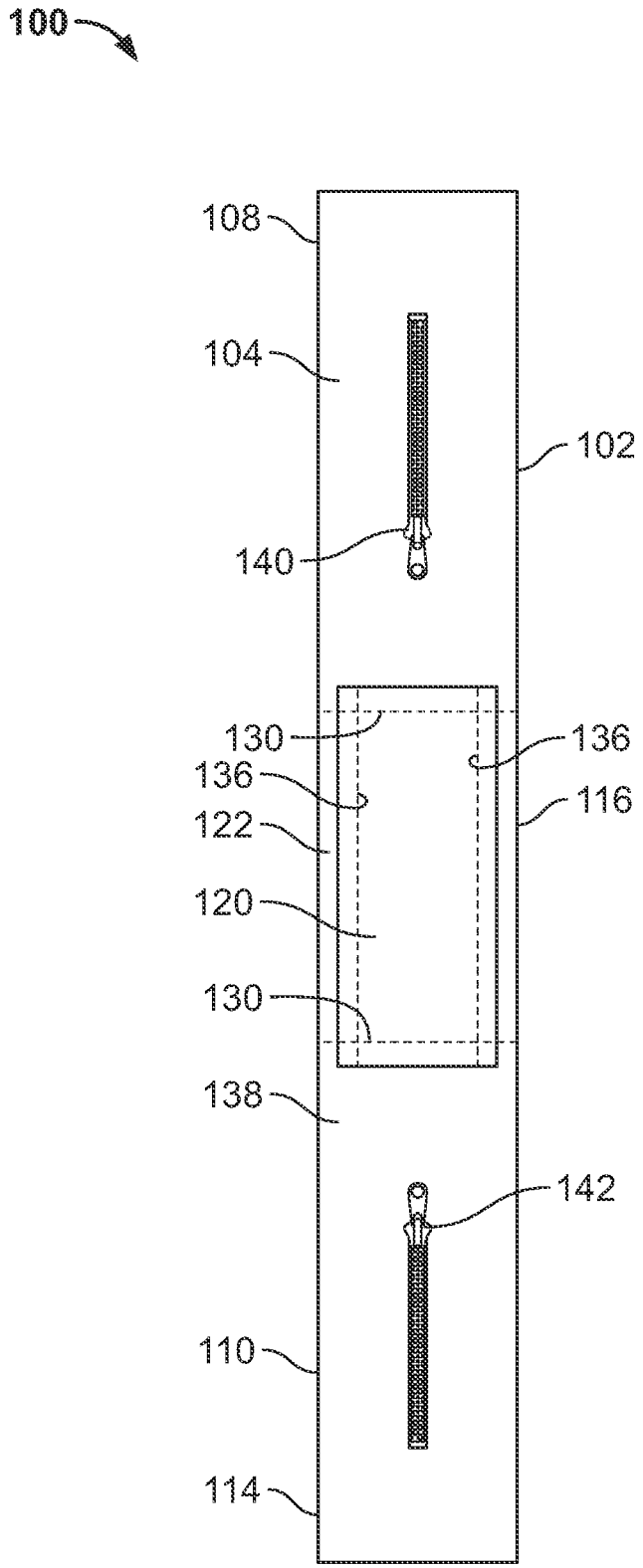
FIG. 4 is a bottom view showing the embodiment of FIG. 1.

As shown in FIG. 4, permeable membrane 120 may be sewn to underside 122 of cooling medium compartment 116 by longitudinal seams 136 and lateral seams, which may be lateral seams 130 that also separate compartment 116 from compartments 104 and 110. As shown in FIG. 4, in an embodiment, beverage compartment zippers 140 and 142 located on underside 138 of holding tube 102 provide access to the underside of first beverage compartment 104 and second beverage compartment 110, respectively. When opened, zippers 140 and 142 allow for first beverage container 106 and second beverage container 112 to be placed in first beverage compartment 104 and second beverage compartment 110 as shown in FIG. 1 through FIG. 4, respectively. In an alternative embodiment, first beverage compartment zipper 104 and second beverage compartment zipper 142 may be located on topside 144 of holding tube 102 as shown in FIG. 1 through FIG. 4.

Figure 5:
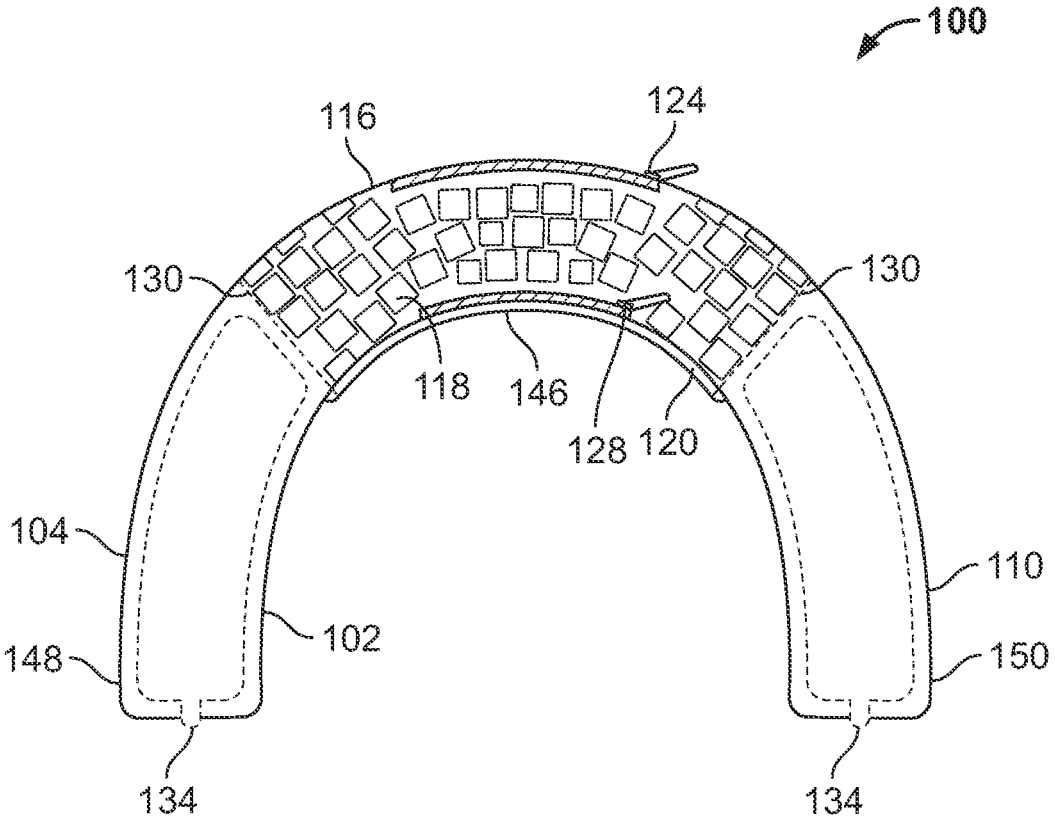
FIG. 5 is a semi-transparent front view of the embodiment of FIG. 1 in a U-shape configuration.

As shown in FIG. 5, holding tube 102 can form a U-shape with bite portion 146 and leg portions 148 and 150, wherein permeable membrane 120 can be placed on the back of the neck of a user, and first beverage compartment 104 and second beverage compartment 110 positioned to rest on the left and right front chest of the user. FIG. 5 shows cooling medium 118, which may comprise any suitable cooling medium, e.g., ice (such as ice cubes), water from melted ice, and/or a cold pack. Cooling medium 118 cools beverages in beverage containers 106 and 112, and can also cool the neck of a user. Cooling medium 118 within cooling medium compartment 116 is in contact with beverage containers 106 and 112 across a respective interface, which includes lateral seams 130. In an embodiment, when holding tube 102 is placed on the back of the neck of a user, first beverage compartment zipper 140 and second beverage compartment zipper 142 (as shown in FIG. 4) are on the backside of holding tube 102 facing the chest of the user, and are thus not accessible from the front of holding tube 102 facing opposite the chest of the user.

If desired, apparatus 100 can be worn by a user. The user can opt to unzip underside zipper 128 to allow water from cooling medium compartment 116 to wet and permeate through permeable membrane 120 to cool the back of the user's neck to provide even more cooling than when water is not allowed wet and permeate through permeable membrane 120.

Figure 6:
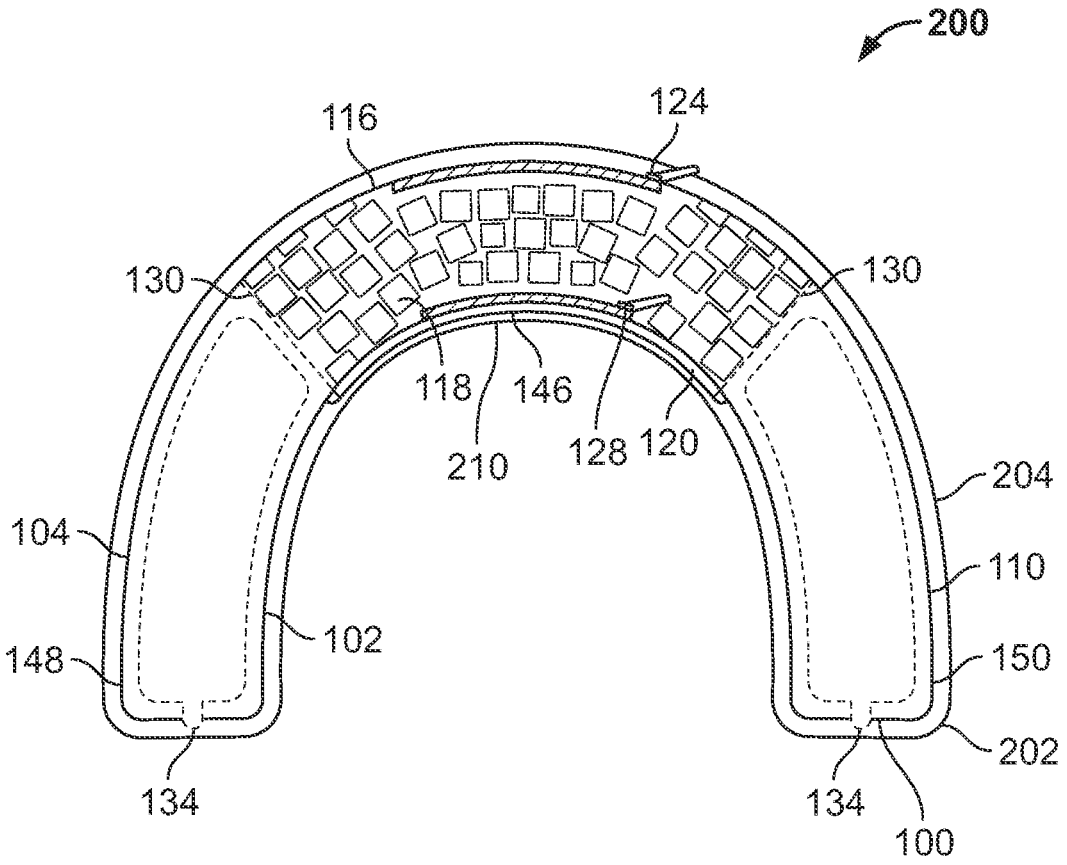
FIG. 6 is a semi-transparent front view of an embodiment according to the invention, wherein the embodiment is U-shape combination of a towel tube and the embodiment shown an FIG. 1.

In the embodiment shown in FIG. 6, apparatus 200 comprises towel tube 202 in combination with apparatus 100 shown in FIG. 1 through FIG. 5. As shown in FIG. 6, holding tube 102 and permeable membrane 120 are located within towel tube 202. Towel tube 202 is water absorbent. Towel tube 202 comprises towel 204 having lateral sides and longitudinal sides, wherein the longitudinal sides are joined together. In an embodiment, the longitudinal sides are sewn or stitched together by a longitudinal seam, or attached by snaps, buttons, or hooks and loops. In this embodiment, towel tube 202 may fastened to holding tube 102 (e.g., by stitching), and together can form a U-shape, wherein bite portion 210 of the U-shape has the cooling membrane compartment 116 and permeable membrane 120 located therein. Bite portion 210 of the U-shape can be placed on the back of the neck of user, and first beverage compartment 104 and second beverage compartment 110 are positioned to rest on the left and right front chest of the user. When underside zipper 128 is in at least a partially open position, water from cooling medium 118, including, e.g., water formed from the melting of ice or condensate from a cold pack in the cooling medium compartment 116 is allowed to wet and permeate through permeable membrane 120, and then wet the bite portion 210 of the U-shape towel tube 202 resting on the back of the user's neck.

In a preferred embodiment, holding tube 102 comprises nylon. In a preferred embodiment, water permeable membrane comprises a clothing or towel fabric.

In an embodiment, the holding tube has similar dimensions as a towel tube. The towel tube may be a typical towel that is about forty-two (42) inches long and about twenty-two (22) inches wide. Thus, the holding tube may be about forty-two (42) inches long and about twenty-two (22) inches wide.

In an embodiment, the length of the cooling medium compartment is about ten (10) inches, wherein seams forming the cooling medium compartment are about ten (10) inches apart. Thus, when the holding tube is about forty-two (42) inches long, the first and second beverage compartments are each about sixteen (16) inches in length.

In an embodiment, the cooling medium compartment can hold at least three (cups) of ice.

In an embodiment, the underside zipper is configured to be unzipped to allow a cold pack to be placed in a pouch formed by the permeable membrane.

In an embodiment, the first and second beverage compartments each have a beverage compartment zipper that can be unzipped to provide an opening so the first and second beverage compartments can receive a first beverage container and a second beverage container, respectively. Each beverage compartment zipper can be zipped closed to maintain the respective beverage container in the respective beverage compartment.

In an embodiment, each beverage compartment zipper and the topside zipper are located along the same linear towel seam, and a narrow flap of the towel tube covers view of the zippers. In an alternative embodiment, the topside zipper is located along the same linear towel seam, and a narrow flap of the towel covers the view of the topside zipper, and each beverage compartment zipper is located longitudinally on underside 138 of the holding tube 102, and are accessible through a respective stitched slit in the towel.

In an embodiment, the apparatus is clothes washing machine compatible.

In an embodiment, the first and second beverage compartments can each have an opening configured to allow a port or drink stem 134 of a beverage container to exit a lateral seam opposite the lateral seam 130 that separates the beverage compartment from the cooling medium compartment. In an embodiment, the port or drink stem 134 can be easily accessed by moving the port or drink stem to the lips of a user. In an embodiment, the towel tube covers the front view of the port or drink stem so that the port or drink stem is not visible looking at the front of the towel tube when apparatus worn around the neck of a user as described above.

In an embodiment, each beverage container may be a bladder or bag that holds at least eight (8) ounces of a beverage.

In an embodiment, apparatus 200 may be used as golf towel.

In an embodiment, a hot pack or heat pack may be placed in the pouch formed by the permeable membrane when it is desired to warm the neck of a user.

Figure 7:
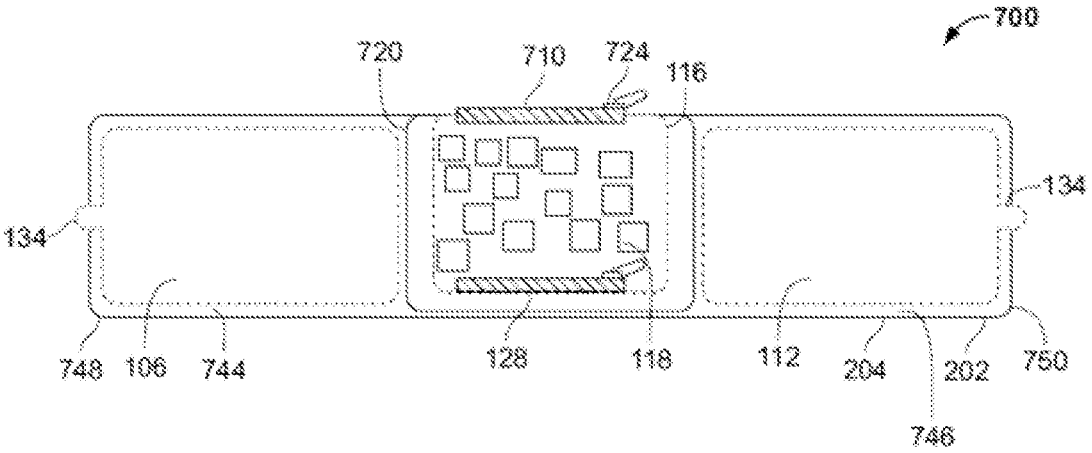
FIG. 7 is a semi-transparent front view of an alternative embodiment according to the invention, wherein the apparatus comprises a water permeable membrane bag that shares the top zipper with the towel tube at the bite or middle portion of the towel tube.
Figure 8:
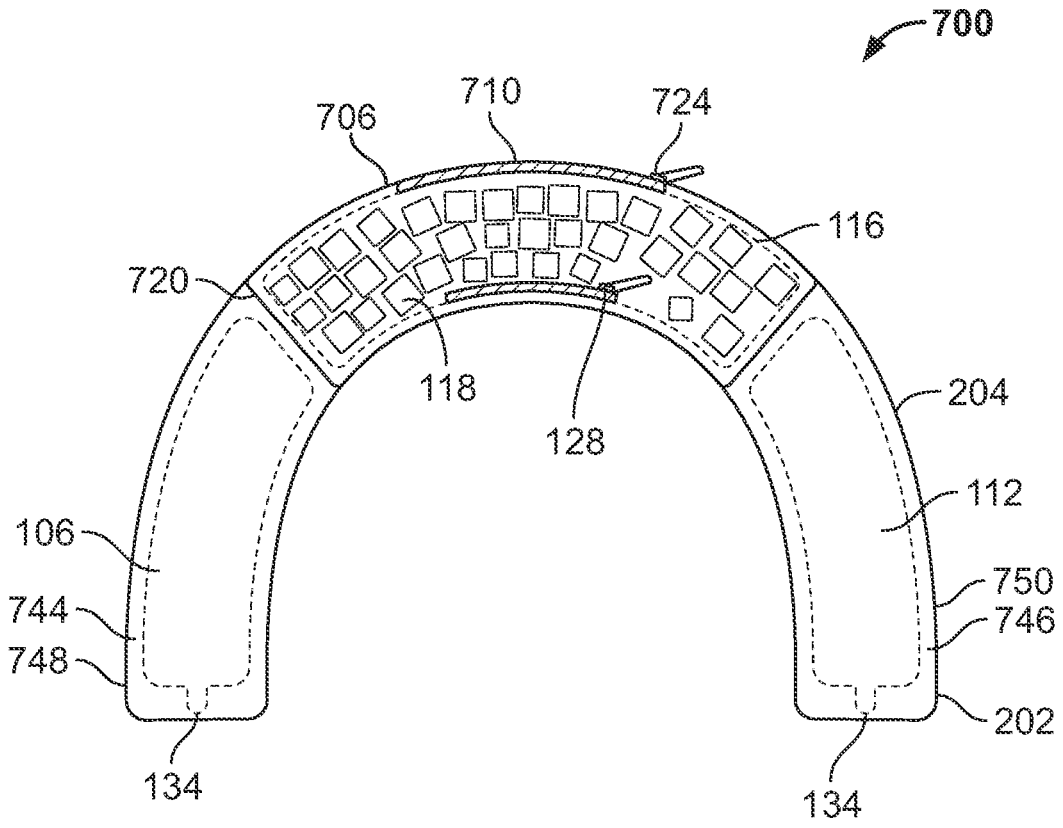
FIG. 8 shows the embodiment of FIG. 7, wherein the embodiment is formed in a U-shape.

An alternative embodiment is shown in FIGS. 7 and 8. As shown in FIGS. 7 and 8, towel tube 202 has first topside zipper 724 at the bite or middle portion 710 of towel tube 202. As shown in FIGS. 7-8, the water permeable membrane is a tube or bag 720 that shares outside or topside zipper 724 with towel tube 202 at the bite or middle portion 710 of towel tube 202. Permeable membrane bag 720 may have, however, a second topside zipper (not shown) that is separate from first topside zipper 724 of towel tube 202. Permeable membrane bag 720 may be affixed to towel tube 202, for example by stitching (not shown) at or near topside zipper 724, or by snaps, buttons or hooks and loops (e.g., Velcro®). Topside zipper 724 may be affixed to towel 204 before towel 204 is rolled to form towel tube 202. The longitudinal sides of towel 204 may be fastened to each other, for example by stitching, snaps, buttons or hooks and loops (e.g., Velcro®).

In the embodiment shown in FIGS. 7 and 8, apparatus 700 comprises cooling medium compartment 116 that is within permeable membrane bag 720, the combination of which may be characterized as a "bag within a bag" 706. In this embodiment, when underside zipper 128 is at least partially unzipped, water from cooling medium compartment 116 can wet and permeate through the permeable membrane bag 720 to cool the user's neck and wet the towel. As shown in FIGS. 7 and 8, cooling medium compartment 116 may share topside zipper 724 with permeable membrane bag 720 and towel tube 202. Cooling medium compartment 116 may have, however, a third topside zipper (not shown) that is separate from first topside zipper 724 of towel tube 202, and second topside zipper (not shown) of water permeable membrane bag 720. The topside zipper of the cooling medium compartment may be separate from top zipper 724 of towel tube 202, but share the second topside zipper of permeable membrane bag 720. In this embodiment, there is no holding tube 102 and there are no seams 130 as shown in FIGS. 1-6. In the embodiment shown in FIGS. 7 and 8, towel tube 202 may comprise first and second side zippers (not shown) to allow access so first beverage container 106 can be placed within first beverage container compartment 744 of towel tube 202 at first section or leg 748 of towel tube 202, and second beverage container 112 can be placed within second beverage container compartment 746 of towel tube 202 at second section or leg 750 of towel tube 202. Permeable membrane 720 may be in contact with beverage containers 106 and 112. With the exception of the foregoing, this embodiment is the same or substantially the same as the structure shown in FIGS. 1-6.

Aspects of the invention relate to a wearable device that can provide cooling or heat to beverages while also providing cooling or heat to the neck of a user. In an aspect, the invention relates to providing a user the option of whether or not to cool the back of the user's neck with a cooling medium placed in the apparatus that wets a water permeable portion of the apparatus that is in contact with the neck of the user. Those having skill in the art, with knowledge gained from the present disclosure, will recognize that various changes can be made to the applications and associated components as described herein, in attaining these and other advantages without departing from the scope of the present disclosure.

What is claimed is:

1. An apparatus comprising:

a holding tube, the holding tube comprising a first beverage compartment at a first section of the holding tube, a second beverage compartment at a second section of the holding tube, and a cooling medium compartment located between the first and second beverage compartments; and a water permeable membrane located below an underside of the cooling medium compartment;

the cooling medium compartment comprising a topside zipper located on the topside of the cooling medium compartment, wherein when the topside zipper is zipped to the closed position, there is no access from outside the holding tube to a space defined by the cooling medium compartment, and wherein when the topside zipper is unzipped to at least a partially open position, access is allowed from outside the holding tube to the space defined by the cooling medium compartment;

the cooling medium compartment comprising an underside zipper located at the underside of the cooling medium compartment, wherein when the underside zipper is zipped to the closed position, there is no opening between the cooling medium compartment and the permeable membrane, and wherein when the underside zipper is unzipped to at least a partially open position, there is an opening between the cooling medium compartment and the permeable membrane to allow water to move from the cooling medium compartment to the permeable membrane.

2. The apparatus of claim 1, wherein the holding tube is made of material that repels water.

3. The apparatus of claim 1, wherein lateral seams separate the cooling medium compartment from the first and second beverage compartments.

4. The apparatus of claim 1, wherein the apparatus has a U-shape with a bite portion, a first leg portion, and a second leg portion, wherein the bite portion comprises the cooling medium compartment, the first leg portion comprises the first beverage compartment, and the second leg portion comprises the second beverage compartment.

5. The apparatus of claim 1, wherein the first beverage compartment comprises a zipper and is configured to receive a beverage container through the first beverage compartment zipper, and the second beverage compartment comprises a zipper configured to receive a beverage container through the second beverage compartment zipper.

6. An apparatus comprising:

a towel tube comprising a towel that is folded over so the longitudinal sides of the towel are adjacent to and fastened to each other;

a holding tube, the holding tube comprising a first beverage compartment at a first section of the holding tube, a second beverage compartment at a second section of the holding tube, and a cooling medium compartment located between the first and second beverage compartments; and a water permeable membrane located below an underside of the cooling medium compartment;

the cooling medium compartment comprising a topside zipper located on the topside of the cooling medium compartment, wherein when the topside zipper is zipped to the closed position, there is no access from outside the holding tube to a space defined by the cooling medium compartment, and wherein when the topside zipper is unzipped to at least a partially open position, access is allowed from outside the holding tube to the space defined by the cooling medium compartment;

the cooling medium compartment comprising an underside zipper located at the underside of the cooling medium compartment, wherein when the underside zipper is zipped to the closed position, there is no opening between the cooling medium compartment and the permeable membrane, and wherein when the underside zipper is unzipped to at least a partially open position, there is an opening between the cooling medium compartment and the permeable membrane to allow water to move from the cooling medium compartment to the permeable membrane.

7. The apparatus of claim 6, wherein the holding tube is made of material that repels water.

8. The apparatus of claim 6, wherein lateral seams separate the cooling medium compartment from the first and second beverage compartments.

9. The apparatus of claim 6, wherein the apparatus has a U-shape with a bite portion, a first leg portion, and a second leg portion, wherein the bite portion comprises the cooling medium compartment, the first leg portion comprises the first beverage compartment, and the second leg portion comprises the second beverage compartment.

10. The apparatus of claim 6, wherein the first beverage compartment comprises a zipper and is configured to receive a beverage container through the first beverage compartment zipper, and the second beverage compartment comprises a zipper configured to receive a beverage container through the second beverage compartment zipper.

11. The apparatus of claim 10, wherein the first beverage compartment zipper and the second beverage compartment zipper are each accessible through a respective stitched slit in the towel.

12. The apparatus of claim 10, wherein a flap of the towel covers the topside zipper, the first beverage compartment zipper, and the second beverage compartment zipper.

13. The apparatus of claim 6, wherein a flap of the towel covers the topside zipper.

14. The apparatus of claim 6, wherein the longitudinal sides of the towel are fastened to each other by a fastening component selected form the group consisting of stitching, snaps, buttons, or hooks and loops.

15. The apparatus of claim 6, wherein the towel tube is fastened to the holding tube.

16. The apparatus of claim 15, wherein the towel tube is fastened to the holding tube by stitching.

17. An apparatus comprising:

a towel tube comprising a towel that is folded over so the longitudinal sides of the towel are adjacent to and fastened to each other, the towel tube having a first topside zipper at a middle portion of the towel tube;

a first beverage compartment at a first section of the towel tube, and a second beverage compartment at a second section of the towel tube, and a cooling medium compartment located between the first and second beverage compartments; and a water permeable membrane bag located between the first and second beverage compartments, the water permeable membrane bag having a second topside zipper at the middle portion of the towel tube; and the cooling medium compartment located within a space defined by the water permeable membrane bag; the cooling medium compartment comprising a third topside zipper located on the topside of the cooling medium compartment, wherein when the third topside zipper is zipped to the closed position, there is no access from outside the towel tube to a space defined by the cooling medium compartment, and wherein when the third topside zipper is unzipped to at least a partially open position, access is allowed from outside the towel tube to the space defined by the cooling medium compartment;

the cooling medium compartment comprising an underside zipper located at the underside of the cooling medium compartment, wherein when the underside zipper is zipped to the closed position, there is no opening between the cooling medium compartment and the water permeable membrane bag, and wherein when the underside zipper is unzipped to at least a partially open position, there is an opening between the cooling medium compartment and the water permeable membrane bag to allow water to move from the cooling medium compartment to the permeable membrane bag.

18. The apparatus of claim 17, wherein the first topside zipper and the second topside zipper are the same zipper, wherein the towel tube and the water permeable membrane bag share the same topside zipper.

19. The apparatus of claim 17, wherein the second topside zipper and the third topside zipper are the same zipper, wherein the water permeable membrane bag and the cooling medium compartment share the same topside zipper.

20. The apparatus of claim 17, wherein the apparatus has a U-shape with a bite portion, a first leg portion, and a second leg portion, wherein the bite portion comprises the cooling medium compartment, the first leg portion comprises the first beverage compartment, and the second leg portion comprises the second beverage compartment, wherein the first beverage compartment comprises a first side zipper and is configured to receive a beverage container through the first side zipper, and the second beverage compartment comprises a second side zipper configured to receive a beverage container through the second side zipper.

21. The apparatus of claim 20, wherein a flap of the towel covers the topside zipper, the first side zipper, and the second side zipper.

22. The apparatus of claim 17, wherein a flap of the towel covers the first topside zipper.

23. The apparatus of claim 17, wherein the longitudinal sides of the towel are fastened to each other by a fastening component selected form the group consisting of stitching, snaps, buttons, or hooks and loops.

* * * * *